United States Patent [19]

Wu

[11] 4,420,007

[45] Dec. 13, 1983

[54] COMPONENT FRAMEWORK STRUCTURE FOR THE FRAME OF A FOLDABLE UMBRELLA

[76] Inventor: Tsun Z. Wu, No. 15, Lan 52, Ho-Ping West Rd., Section 3, Taipei, Taiwan

[21] Appl. No.: 338,267

[22] Filed: Jan. 11, 1982

[51] Int. Cl.[3] ..... A45B 19/00

[52] U.S. Cl. ..... 135/25 R

[58] Field of Search ..... 135/22 R, 25 R, 25 A, 135/36 R, 36 F, 31, 26

[56] References Cited

U.S. PATENT DOCUMENTS 3,638,668 2/1972 Kida ..... 135/20 R
3,848,740 11/1974 Weber ..... 135/25 R

FOREIGN PATENT DOCUMENTS 6447 of 1912 United Kingdom ..... 135/25 R
500709 2/1939 United Kingdom ..... 135/25 R
753177 7/1956 United Kingdom ..... 135/25 R
1266264 3/1972 United Kingdom ..... 135/25 R

*Primary Examiner*—Harland S. Skogquist
*Attorney, Agent, or Firm*—McGlew and Tuttle

[57] ABSTRACT

A component framework structure for a foldable umbrella avoids channeled frame parts so as to make its various auxiliary stretchers fold into an abreast position instead of overlapping. Various stretchers on both the left and right sides have flat and thin structures, while their head joints are in conjunction with an upper notch member of the umbrella hereby the joints are positioned under the bottom of the notch. The outside part of the joints thus do not protrude beyond the diameter of the upper notch, so that the tail part of the foldable umbrella, after it is folded up, becomes very slim with new practical effectiveness achieved in its carrying, packing and outer appearance.

8 Claims, 14 Drawing Figures

FIG. 6A
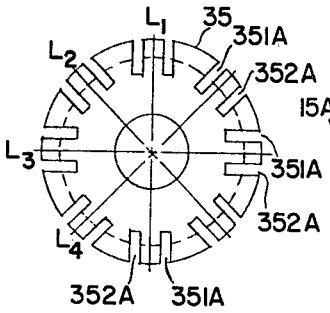
FIG. 6B
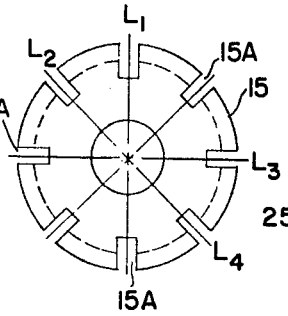
FIG. 7
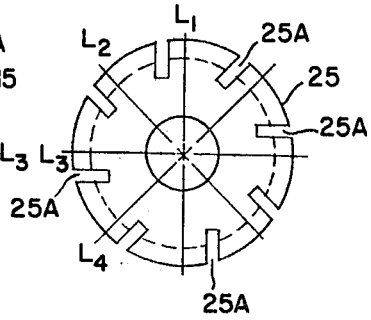
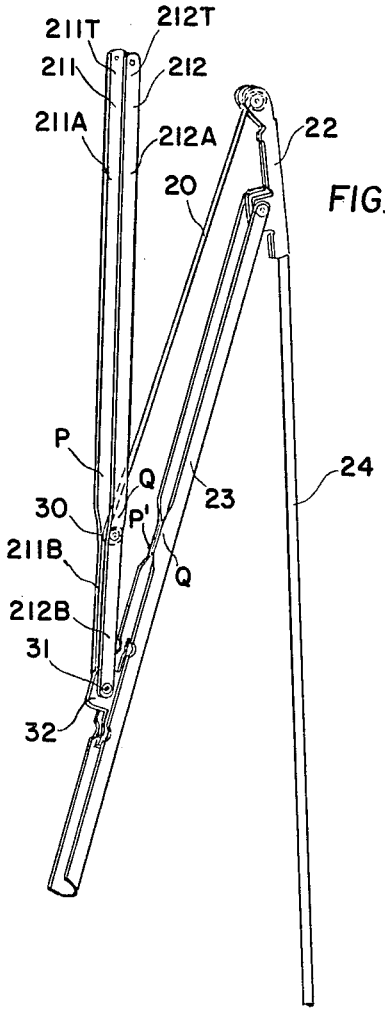
FIG. 5

COMPONENT FRAMEWORK STRUCTURE FOR THE FRAME OF A FOLDABLE UMBRELLA

FIELD AND BACKGROUND OF THE INVENTION

The presented invention relates to a foldable umbrella framework structure, especially an umbrella whose volume is reduced after it is folded up so as to make the umbrella portable and graceful, convenient in carrying and packing and nice-looking.

In a commonly used foldable umbrella, after it is folded up, the volume in the tail or end part appears rather bulky so that the whole umbrella has no slim appeal. Aside from whether its outer appearance is nice or not, because its volume is comparatively bigger after being folded up (in fact, its cross diameter is bigger), and particularly the overall diameter of the tail part of the umbrella is bigger than that of any other part, after the umbrella is folded up, it will be very troublesome and time-consuming to put the folded umbrella into its jacket. Besides, if this umbrella is put into a lady's handbag or a gentleman's suitcase or any other box or bag, its bulky volume shall occupy a lot of space, thus reducing the space otherwise available for other articles. In terms of export (and also domestic sales), the transport cost of such umbrellas depends on their measurement of the related packing. If each umbrella has a bigger volume, the number of umbrellas which can be loaded into a carton will become less and therefore, the number of cartons needed to accommodate the same total number of umbrellas in one shipment will be increased, thus heightening transport costs.

Consequently, under the principle of not adversely affecting the basic specifications such as strength, stress and so on of the umbrellas, how to reduce the volume of the foldable umbrellas after they are folded up, is always the objective that the related industry has been untiringly pursuing.

Referring to FIGS. 1 and 2, it will be seen why the volume of the commonly used foldable umbrella, after it is folded up, becomes bulky and especially why the diameters of its tail or end part is bigger. This is, in fact, due to the poor frame structure of the commonly used foldable umbrella. FIG. 1 is a perspective view of the framework structure of the frame part of the commonly used foldable umbrella. As for the component framework structure of the frame of the foldable umbrella, the upper end 10A of a round tension rib 10 is pivotally connected to channel 11A of channeled auxiliary stretchers 11. After the umbrella is folded up, the drawing and pushing actions by various elements of the component framework structure make these elements fold up against each other. In a direction facing the umbrella from the outside to the inside thereof, there are provided, in sequence, head joint 12, and main round rib 14 that inserts into and connects with this head joint, stretchers 13, tension rib 10 and auxiliary stretcher 11. Since they are connected from top to bottom (i.e. from outside to inside) layer by layer, just imagine why the result of such an up and down overlapped connection would make the umbrella appear bulky after it is folded up! Since the various head joints 12 are positioned beyond the outer diameter of upper notch or notch member 15 (FIG. 2), the diameter of the winding body constituted by the various head joints 12 is certainly bigger than that of the winding body constituted by the various joints 18 (that connect stretchers 11, 13), thus making the tail or end part of the umbrella rather bulky. Especially as for the folded up topless umbrella, the umbrella fabric is self-folded in the tail part, and when the fabric is folded up, the fabric piled and overlapped on each frame in the tail part is above 30 pieces, thus making the tail part even more bulky. In general, the process of putting the folded umbrella into its jacket, with the tail part first inserted into the jacket which has a smaller opening diameter, is an inconvenient and time-consuming procedure.

SUMMARY OF THE INVENTION

Objects of the present invention include the provision of an improved component framework structure for the frame of a foldable umbrella, the provision of such a component framework structure utilizing a slim, plain plate as an auxiliary stretcher, and the provision of such an umbrella with remarkably reduced volume especially in its tail part, after it is folded.

Another object of the present invention is the provision for an improved component framework structure of the frame of a foldable umbrella in which a plurality of parallel auxiliary stretchers are provided for adapting either a conventional or a unique upper notch in accordance with the present invention. A still further object of the present invention is to provide an improved component framework structure for the frame of a foldable umbrella wherein a unique joint is disclosed for adapting said special parallel auxiliary stretchers onto a main stretcher. A further object of the present invention is to provide an improved component framework structure for the frame of a foldable umbrella wherein the position of a head joint is under the bottom of the upper notch so as to attain a volume reduction of the foldable umbrella especially at its tail or end.

BRIEF DESCRIPTION OF THE DRAWINGS

In order that the present invention may be more clearly understood and readily carried into practice, a presently preferred embodiment thereof is illustrated by way of example in the accompanying drawings, wherein like numerals refer to like parts throughout, and in which:

FIG. 5 is a perspective view of a further embodiment of an improved component framework mechanism in accordance with this invention.

FIG. 6A is a plane view of the upper notch in coordination with the practical example as shown in FIG. 5.

FIG. 6B is a plane view of an upper notch as used by the traditional umbrella.

FIG. 7 is a plane view of a unique upper notch as provided by the component framework according to the invention.

Figures 8A, 8B:
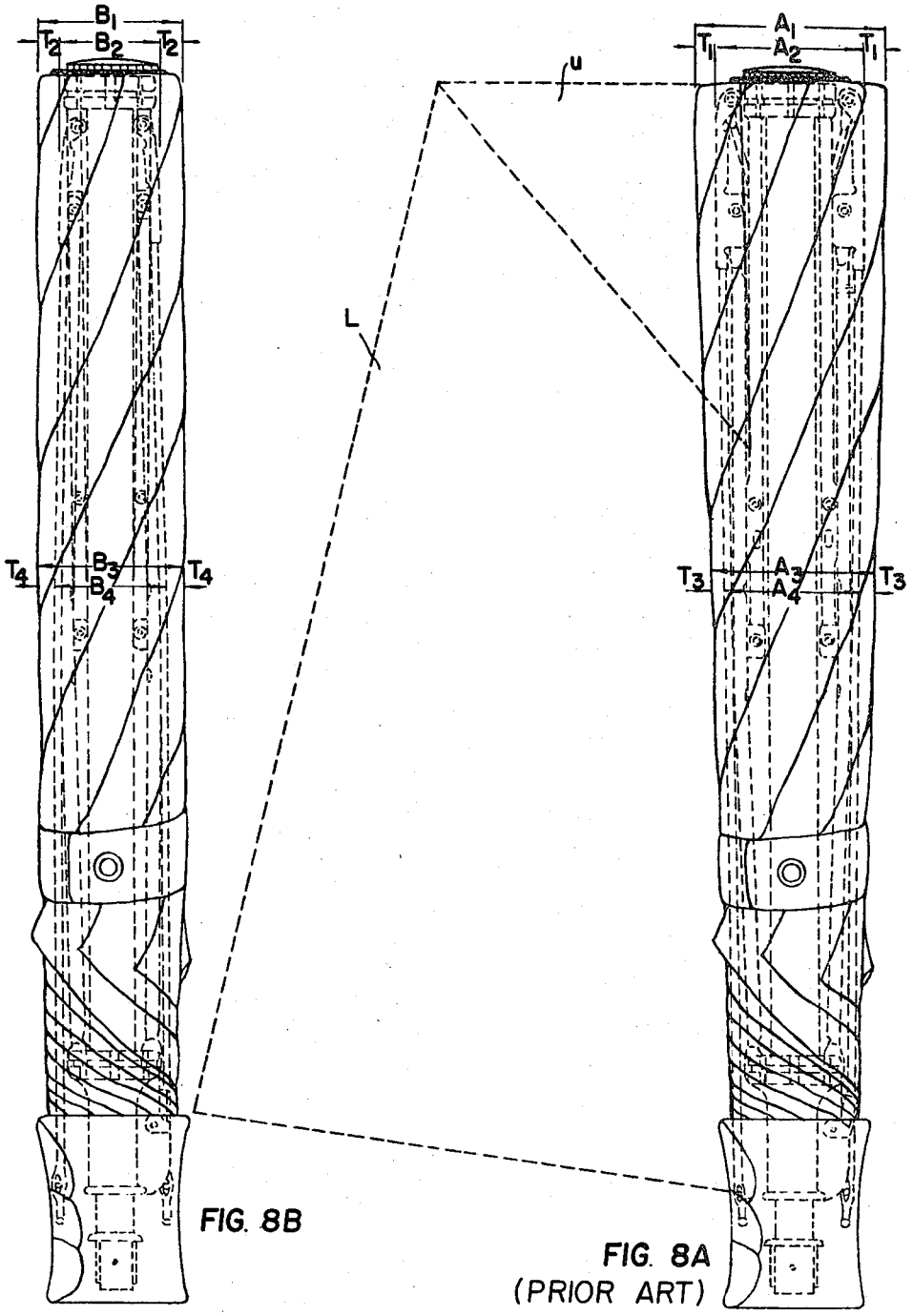
FIG. 8A (PRIOR ART)
FIG. 8A is a perspective view of a commonly used foldable umbrella after its cover is applied where it can be seen that A2 is larger than A4, also the measurement of T1 is twice T3 (4 layers of cloth are in zone U, while only 2 layers of cloth are in zone L ) and so that A1 (A1=A2+2T1) will be greatly larger than A3 (A3=A4+2T3).
FIG. 8B is a perspective view of an improved foldable umbrella according to this invention after its cover is applied where it can be seen that since B2 is smaller than B4, so even T2 is still twice of T4, and the total volume of the tail part B1 (B1=B2+2T2) will be no bigger than middle part B3 (B3=B4+2T4).

Comparing these two figures (FIG. 8A and 8B), we also can find that A3 is roughly equal to B3, while A1 is larger than B1.

Figure 9:
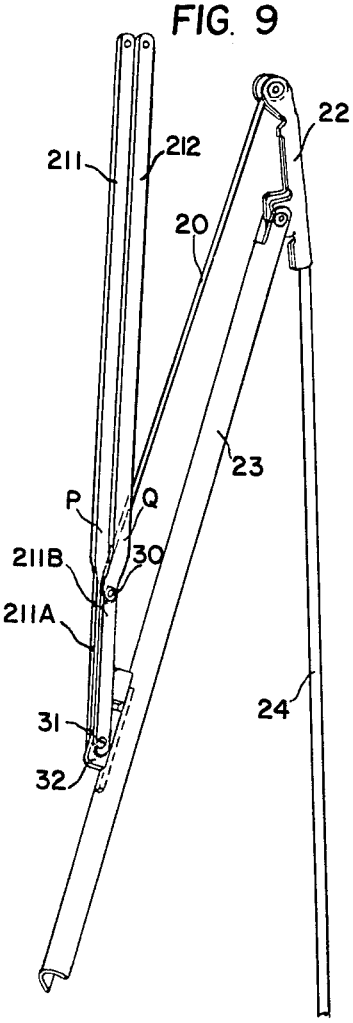

FIG. 9 is a simple synoptic view of the application of the joint used in a 3rd embodiment according to the invention.

Figure 10A:
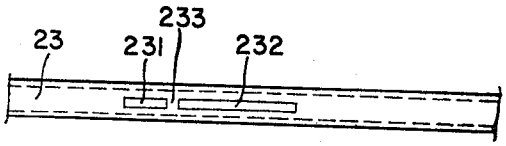
Figure 10C:
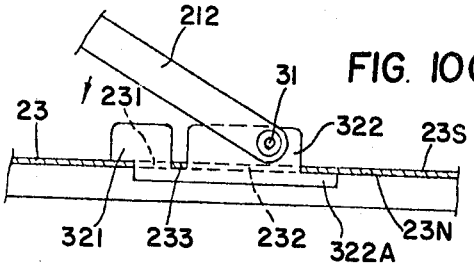
Figure 10B:
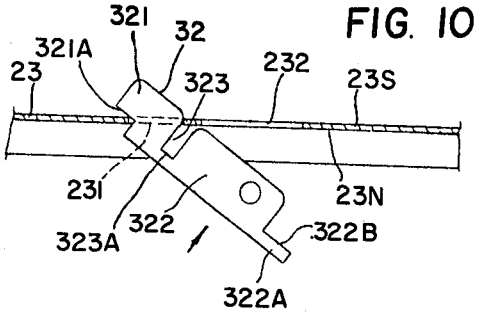

FIGS. 10A to 10C are descriptive views of the structure of the joint and the applicatory status of the auxiliary stretcher.

DETAILED DESCRIPTION OF THE INVENTION

Figure 2:
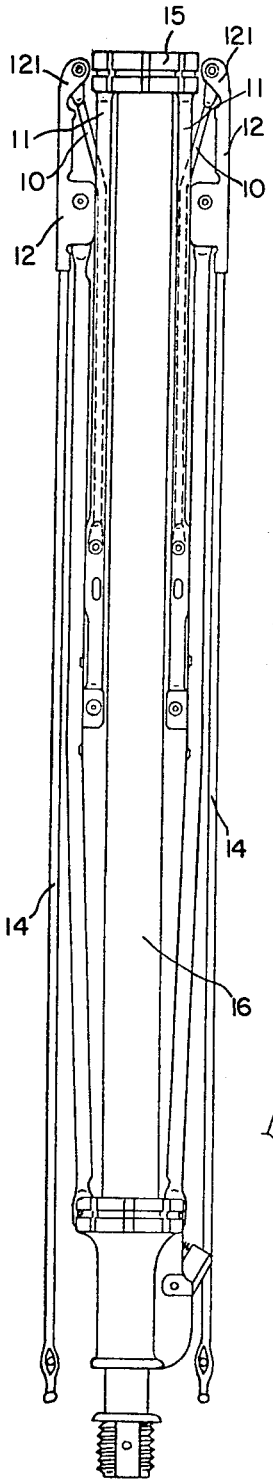
FIG. 2 (PRIOR ART)
FIG. 2 is a longitudinal view of a component framework structure of a traditional, foldable umbrella after it has been folded up.
Figure 1:
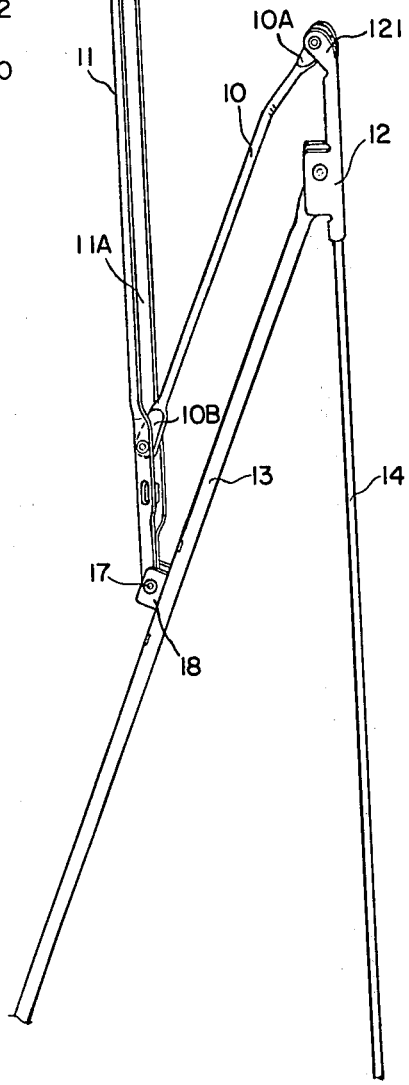
FIG. 1 (PRIOR ART)
FIG. 1 is a perspective view which depicts part of a component framework structure of a traditional, foldable umbrella.
Figure 4:
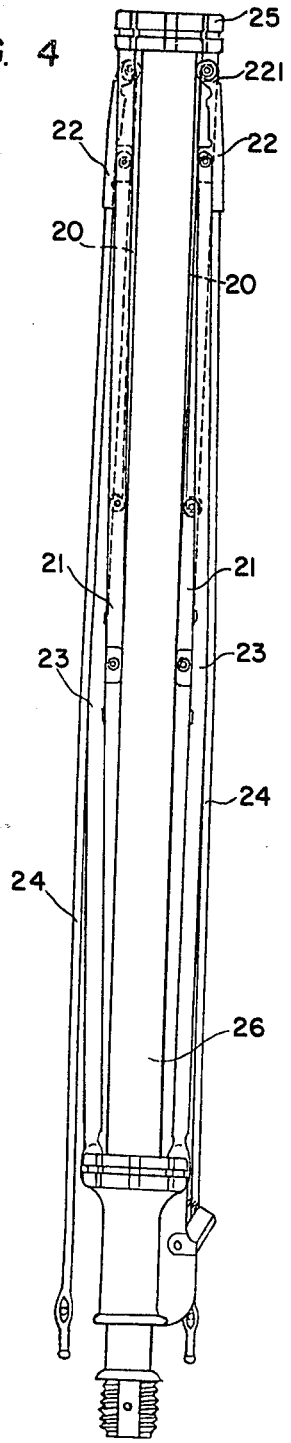
FIG. 4 is a longitudinal view of an improved component framework structure of a foldable umbrella according to the invention after the umbrella has been folded up.
Figure 3:
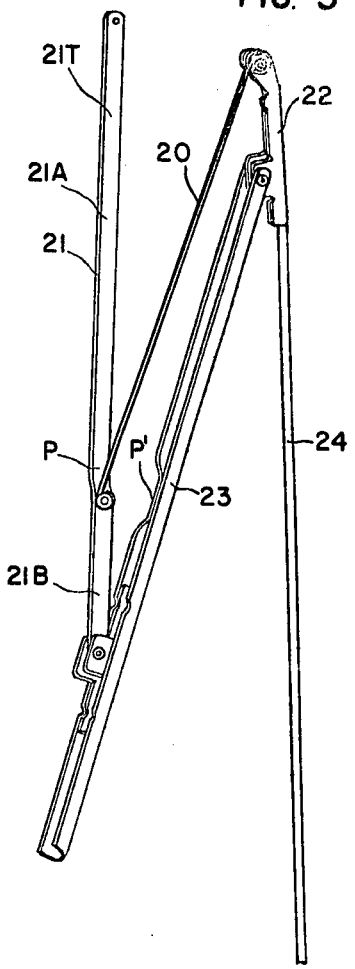
FIG. 3 is a perspective view which depicts part of an improved component framework structure of a foldable umbrella according to the present invention.

As shown in FIG. 3, the first feature of this invention lies in the auxiliary stretcher 21 which is made of steel sheet and its thickness is thinner than that of the commonly used channeled auxiliary stretcher 11 (as shown in FIG. 1). At the position P under tension rib 20 and close to the connection point of the axle of the auxiliary stretcher 21, auxiliary stretcher 21 is deflected more to the right than that of lower plane 21B (its deflection to the left is also possible). The relative position of P in main stretcher 23, at P', is also depressed to avoid interference with auxiliary stretcher 21 when folded. After the umbrella is folded up by means of the drawing and pushing of tension rib 20 and stretcher 23, upper part 21A of auxiliary stretcher 21 forms a left and right abreast formation (in terms of the direction facing the umbrella after it is folded up) with stretcher 23. Thus, outside the shaft 26, various auxiliary stretchers 21 (in total, eight of them in general) form an abreast circular formation as shown in FIG. 4, and thus the umbrella becomes smaller. As for the traditional, foldable umbrella, various auxiliary stretchers 11 overlap with various stretchers 13 (also in terms of the direction facing the folded umbrella) and therefore, the radius of shaft 16 facing outside increases, thus making the volume bigger. Please compare FIGS. 1-2 and FIGS. 3-4 (all drawn in the same scale) to understand this. Again, tension rib 20 can be made of a linear type of steel rod with proper rigidity to afford the hook holes (not shown in the figures) of both its ends for pivotal connections, thus making the volume of the tension rib even smaller.

The second feature of this invention is shown in FIG. 7. Upper notch 25 is connected to the auxiliary stretchers 21 at channels 25A—25A in a special structural arrangement. Referring to the commonly used upper notch structure as shown in FIG. 6B, the commonly used upper notch 15 receives various auxiliary stretchers 11 which are inserted into its various channels 15A—15A set up on the dividing lines $L_1$–$L_4$ which divide the circle of the notch into eight eual divisions. The component framework structure of this invention is different. According to the structure of the upper notch of this invention, various channels 25A—25A are not provided on dividing lines $L_1$–$L_4$ but on the side of these dividing lines, and thus are parallel to $L_1$–$L_4$. Therefore, as shown in FIG. 3, the tail part 21T of auxiliary stretcher 21 can keep its original manufacturing straight form and is directly inserted into one of the channels 25A—25A of these deflective dividing lines $L_1$–$L_4$. Resultantly, there is no need for any additional bending on the tail part 21T of the various auxiliary stretchers 21, thus saving a lot of time and work. However, if the commonly used upper notch structure 15 is adopted, the commonly seen bend must be made on the tail part 21T of auxiliary stretcher 21 as shown in FIG. 3 in order to insert it into one of the channels 15A—15A. Therefore, it is all right to adopt the commonly used upper notch 15 or the upper notch 25 described as the second structural feature of this invention.

FIG. 5 shows the third practical example of this invention and is different from what is shown in FIG. 3, since both auxiliary stretchers 211 and 212 are made parallel to each other and at the places P and Q close to the pivotal connection of tension rib 20, a slight bend is made. The relative positions of P and Q in stretcher 23, at P' and Q', are also depressed to keep from causing interference with auxiliary stretcher when the umbrella is folded. These two parallel auxiliary stretchers 211 and 212 form a Y shape with each of them having upper parts 211A and 212A and lower parts 211B and 212B. Tension rib 20 is pivotally connected between auxiliary stretchers 211 and 212 by rivet 30.

Additionally, both lower ends of auxiliary stretchers 211 and 212 are pivotally connected by another rivet 31 to both sides of joint 32.

As both auxiliary stretchers 211 and 212 are made parallel to each other, a slight change must be made on the upper notch structure as shown in FIG. 6A, whereas on both sides of the dividing lines $L_1$–$L_4$ which make eight equal divisions, double channels 351A-352A parallel to each dividing line are formed. By doing so, the tail ends of 211T and 212T of these auxiliary stretchers 211 and 212 can be inserted into channel 351A and 352A of upper notch 35 respectively.

Comparing FIG. 5 and FIG. 1, the channel 11A of the commonly used auxiliary stretcher 11 (in FIG. 1) is in the right direction as shown in FIG. 1, but the channel (also can be called the space between the two auxiliary stretchers 211 and 212) formed between the two parallel auxiliary stretchers 211 and 212 of the third practical example of this invention is a two-way communicable one (as shown in FIG. 5). Therefore, in the commonly used structure in FIG. 1, auxiliary stretcher 11 is pivotally connected by rivet 17 at the place between two side plates of the U-shaped joint 18 to pivotally rotate within this U-shaped joint 18, whereas this U-shaped joint 18 is fixedly connected to the channel of stretcher 13. However, another practical example of this invention is different in this regard. As shown in FIG. 9, the lower ends of two auxiliary stretchers 211 and 212 are pivotally connected by rivet 31 to the outside part of joint 32, and the length of joint 32 is longer than that of the commonly used one 18. Please compare FIG. 9 and FIG. 1.

Additionally, the connection method between the structure of joint 32 and stretcher 23 of this practical example is also different from that of the commonly used one. The joint 32 of this invention is fixedly connected to the "back" of stretcher 23 (as shown in FIG. 9). As shown in detail in FIG. 10A, two slots 231 and 232 that are not mutually communicable are provided on stretcher 23 and between channels 231 and 232 is a physical body 233, thus causing no impact on the strength of stretcher 23.

Joint 32 has a shorter part 321 and a longer part 322 with finger 322A, and between these two parts, there is a concave channel 323, as shown in FIG. 10B. During installation, the shorter part 321 protrudes downwardly along stretcher 23 and beyond the shorter channel 231, and then longer part 322 protrudes downward along stretcher 23 and beyond longer channel 232 as shown in FIG. 10C. At this moment, bottom surface 321A of shorter part 321, finger part 322A of longer part 322 and bottom surface 323A of concave channel 323 contact back surface 23N of stretcher 23 respectively as shown in FIG. 10C.

Auxiliary stretcher 212 (just use one for illustration) is pivotally connected by rivet 31 to longer part 322 (outside part) of joint 32 as shown in FIG. 10C. When auxiliary stretcher 212 pivotally rotates during folding the umbrella, shorter part 321 of joint 32 is caught and stopped at outer surface 23S of stretcher 23, while finger part 322A of longer part is caught and stopped on inner surface 23N of stretcher 23. On the contrary, if auxiliary stretcher, 212 pivotally rotates during stretching the umbrella, concave channel bottom surface 323A of joint 32 is caught and stopped on the bottom surface of stretcher 23, thus making joint 32 fixedly connected. In such a structure under this invention, this joint 32 can be used as guide for auxiliary stretchers 211 and 212, and whether stretching or folding the umbrella, especially the latter, these two auxiliary stretchers are definitely in fixed positions. In other words, its free interval at the pivotal connection point will never increase to the extent of dislocation.

Summing up, the component framework structure of the frame of a foldable umbrella in accordance with the present invention is an improved version on the structure of the auxiliary stretchers, the upper notch, and the head joint, to obtain a reduction in its cross volume after the umbrella is folded up and to make various aspects such as carrying and packing very practical and convenient. While furthermore, as for the structure of this invention, there is never any similar product ever witnessed or made available on the open market or publications for sale, and the structure of this invention is not so easily thought out by persons in the same line of business, thus making this invention as a sort of new practical article.

One point the inventor has to clarify here is that all the above features of this invention can be taken individually and or collectively for any combination desired to equally reach the delicate and agile effectivenesses by reducing the cross volume of umbrella after it is folded up especially in its tail part and it is unnecessary to impose any limits on the adoption of the fixed several kinds of these features simultaneously. As various modifications could be made in the structures herein described and illustrated without departing from the scope if the present invention, it is intended that all matter attained in the foregoing description or shown in the accompanying drawings shall be interpreted as illustrative rather than limiting.

What is claimed is:

1. A component framework structure for the frame of a foldable umbrella comprising:

an upper notch member;

an auxiliary stretcher made of at least one piece of flat plate material having a bend therein so that an upper portion of said auxiliary stretcher extends in a different plane from a lower portion thereof, said auxiliary stretcher being pivotally connected at a top end thereof to said notch member;

a tension rib pivotally connected at one end thereof to said auxiliary stretcher adjacent said bend;

a main rib pivotally connected at one end thereof to an opposite end of said tension rib; and a main stretcher pivotally connected at a top end thereof to said main rib at a point on said main rib spaced from its ends, said main stretcher pivotally connected at an intermediate location thereon to a lower end of said auxiliary stretcher;

the pivotal connection between said main stretcher and main rib, and between said main rib and said tension rib forming a head joint which, with said umbrella folded, lies next to said auxiliary stretcher upper portion.

2. A component framework structure according to claim 1, wherein said auxiliary and main stretchers are pivotally connected to each other at a position and have selected lengths so that, with said umbrella folded, said head joint lies under at least a portion of said notch member.

3. A component framework structure according to claim 1, wherein said upper notch member includes a circular array of channels each adapted for pivotal connection to one of said auxiliary stretchers, each channel extending on a side of a line centrally dividing said notch member into two equal halves.

4. A component framework structure according to claim 1, wherein said upper notch member includes a circular array of channels each extending radially on a respective center line passing through said upper notch member, said upper portion of said auxiliary stretcher being bent to pivotally engage one of said radially extending channels.

5. A component framework structure according to claim 1, wherein said auxiliary stretcher comprises an additional piece of flat plate material extending generally parallel to said first mentioned piece of flat plate material having a bend therein between an upper and a lower portion of said additional piece of flat plate material, said bend of said first mentioned and additional flat plate material extending in directions opposite each other to form a Y-shaped auxiliary stretcher having closely spaced bottom portions and more widely spaced upper portions, lower ends of said lower portions engaged and pivotally connected on opposite sides of a joint member connected to said main stretcher.

6. A component framework structure according to claim 5, wherein said joint member is connected to a back of said stretcher facing inwardly of said umbrella with said umbrella folded.

7. A component framework structure according to claim 5, wherein said upper notch member includes a plurality of circumferentially spaced pairs of channels each channel of each pair extending on opposite sides of a central radial line extending through said notch member, at least one pair of channels pivotally receiving each upper end of said upper portions of said first and additional piece of flat plate members forming said auxiliary stretcher, said head joint with said umbrellas folded being positioned at least partly between said upper portions of said auxiliary stretcher.

8. A component framework structure according to claim 6, wherein said joint member has a shorter part and a longer part with a concave channel therebetween, said longer part including a finger, said auxiliary stretcher pivotally connected to said longer part, said main stretcher including a channel for each of said shorter and longer parts of said joint member with said finger engaging a lower surface of said main stretcher, said shorter part, with said umbrella folded, extending between said first mentioned and additional pieces of flat plate material.

* * * * *